US006493902B2

(12) United States Patent
Lin

(10) Patent No.: US 6,493,902 B2
(45) Date of Patent: Dec. 17, 2002

(54) AUTOMATIC WALL CLEANSING APPARATUS

(76) Inventor: Chung-Yi Lin, 2fl., No. 29, Lane 109, Sec. 2, Baufu Rd., Yunghe City, Taipei Hsien (TW)

( * ) Notice: Subject to any disclaimer, the term of this patent is extended or adjusted under 35 U.S.C. 154(b) by 0 days.

(21) Appl. No.: 09/789,607

(22) Filed: Feb. 22, 2001

(65) Prior Publication Data

US 2002/0112312 A1 Aug. 22, 2002

(51) Int. Cl.[7] ..... A47L 1/02; A47L 11/38
(52) U.S. Cl. ..... 15/302; 15/316.1
(58) Field of Search ..... 15/302, 316.1

(56) References Cited

U.S. PATENT DOCUMENTS 3,775,804 A * 12/1973 Hoener, Jr. ..... 15/302
3,999,242 A * 12/1976 Maruyama et al. ..... 15/302
4,136,419 A * 1/1979 Hetman et al. ..... 15/302
4,198,724 A * 4/1980 Fisher et al. ..... 15/302
4,797,969 A * 1/1989 Caduff ..... 15/302
4,800,607 A * 1/1989 Fukutomi ..... 15/302
5,020,180 A * 6/1991 Mimura ..... 15/302
5,502,868 A * 4/1996 Braendle ..... 15/302

* cited by examiner

*Primary Examiner*—Theresa T. Snider
(74) *Attorney, Agent, or Firm*—Rosenberg, Klein & Lee

(57) ABSTRACT

An automatic wall cleansing apparatus is provided that includes a work platform, a lift unit, a supporting frame, a rotatable brush assembly, a blower unit, and a control unit. The work platform is moved up to a working position, by presetting the control unit. The work platform is lifted to the topmost portion of the building and downwardly executes the cleansing work with the aid of air supplied by the blower unit and a rubbing operation by the rotatable brush assembly. From the supply of detergent, cleansing, spraying of clean water, to drying by hot air, all of the steps are carried out automatically and successively without the need of manual operation.

16 Claims, 7 Drawing Sheets

AUTOMATIC WALL CLEANSING APPARATUS

BACKGROUND OF THE INVENTION

1. Field of the Invention

The present invention relates to an automatic wall cleansing apparatus, and more particularly, to an automatic wall cleansing apparatus which can reduce the use of manpower and natural resources, and in addition, improve work safety.

2. Description of the Prior Art

At present, wall cleansing for a high rise building is mostly carried out by manpower. The most common procedure is to lift up a work crew with a winch car and settle them down at individual positions, and then let them begin to work. However, such a conventional method has several shortcomings:

1. A considerably large amount of labor and work time along with necessary energy such as water and electric power are required, resulting in a high cost.
2. Skillful and experienced workers in this field are required.
3. For a large high rise building with wide wall areas, cleansing work is not only tiresome and time consuming, but also causes a problem in that a previously finished portion of the wall may become contaminated by dust or used water coming from an adjacent portion being cleaned. As a result, working efficiency is low with poor quality of the finished work.
4. Work safety cannot be satisfactorily assured because workmen have to work at a high altitude in a dangerous environment.

Although, some improvements have been made in the technique for high rise building wall cleansing, for example, providing a small sized electrically driven cleansing device and providing certain corrosive, strong acidic materials that are basically effective for improving cleansing techniques. Yet, the device and chemical materials are bulky or dangerous to store. A more reliable idea needs to be implemented for the sake of facilitating high rise building wall cleansing work.

Therefore, an invention devoted to resolving the aforesaid disadvantages of current practice in cleansing a high rise building wall, and for saving labor, time, water and electricity is necessary.

SUMMARY OF THE INVENTION

The main object of the present invention is to provide an automatic wall cleansing apparatus which can save labor, time, water and electricity and improve work safety as well.

To achieve the above mentioned object, the present invention comprises a work platform for accommodating a work crew and equipment, a lift unit, a supporting frame, a rotatable brush assembly, a blower unit, and a control unit. The work platform is moved up to a working position. By means of presetting the control unit, the working platform is lifted to the topmost portion of the building and then gradually and downwardly executes cleansing work with the aid of air supplied by the blower unit and the rubbing operation of the brush assembly against the wall. From supply of detergent, cleansing, spraying of clean water to hot air drying, all of the steps are carried out successively in order, without the need of a working crew being lifted up to a high altitude entrained on the work platform.

BRIEF DESCRIPTION OF THE DRAWINGS

For a more full understanding of the nature and objects of the invention, reference should be made to the following detailed description taken in conjunction with the accompanying drawings in which.

DETAILED DESCRIPTION OF THE PREFERRED EMBODIMENT

Figure 1:
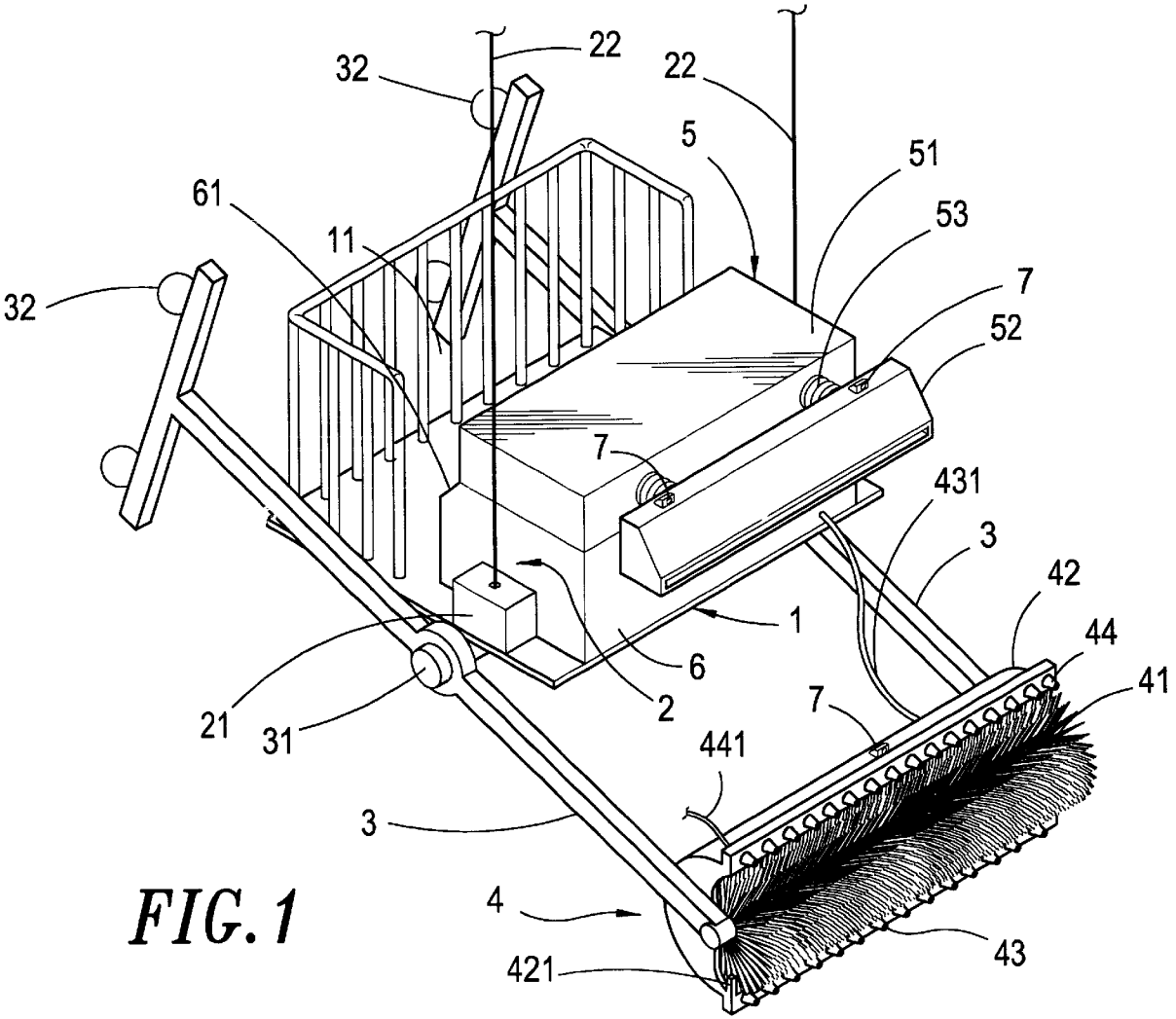
FIG. 1 is a perspective drawing viewed from the top of the present invention.
Figure 2:
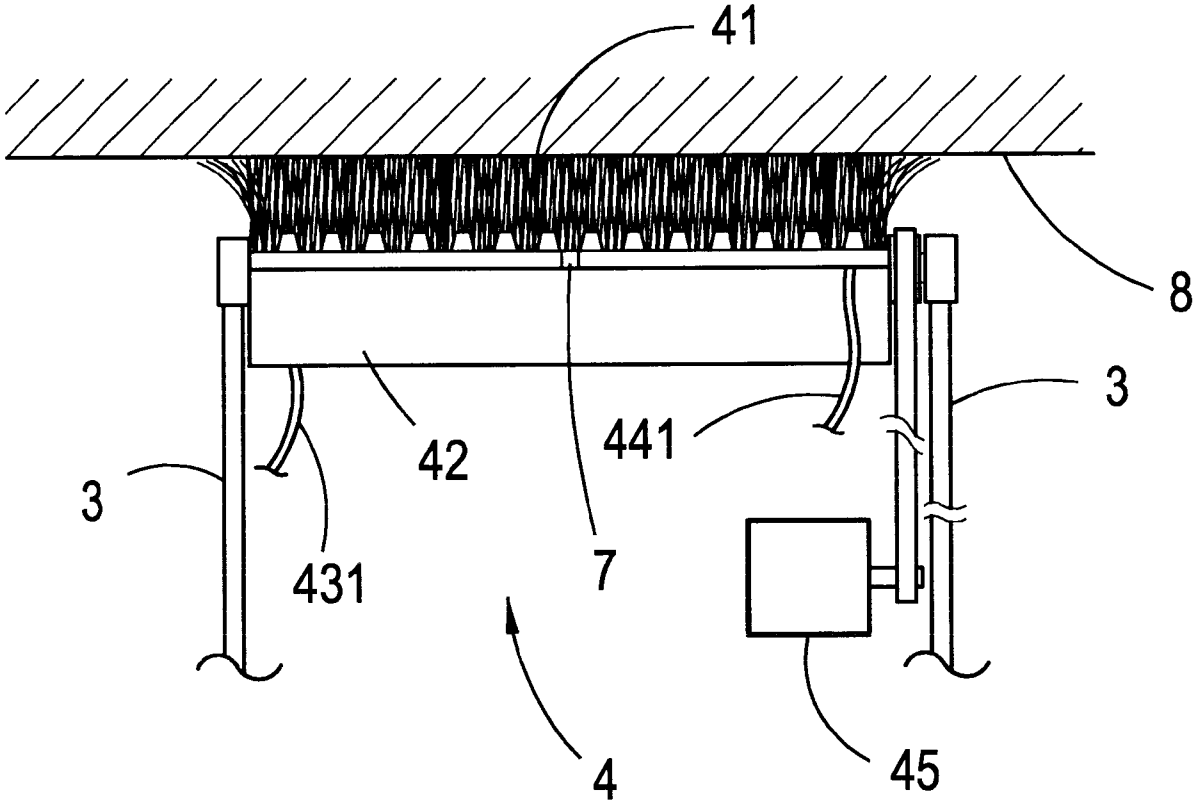
FIG. 2 is a drawing illustrating operation of the brush assembly of the present invention.

Referring to FIGS. 1 and 2, the automatic wall cleansing apparatus of the present invention comprises: A work platform 1 for accommodating equipment to be discussed later on, and providing space 11 allowing a work crew to stand thereon with a protecting railing 12 therearound.

A lift unit 2 having two lifts 21 mounted respectively at two sides of the work platform 1, each lift 21 is hung by a steel cable 22 which is anchored at the topmost position of the building wall 8, the work platform is thereby able to move up and down along the building wall 8 following the movement of the steel cable 22.

A supporting frame 3 with its pivot axle 31 pivoted on the work platform 1 such that the supporting frame 3 is turnable with respect to the pivot axle 31. Moreover, four castors 32 are provided for the supporting frame 3. When the supporting frame 3 is turned to a position perpendicular to the ground, the castors 32 may be used to transport the work platform on the ground.

A brush assembly 4 is attached to the top portion of the supporting frame 3. The brush assembly 4 is composed of a rotatable brush unit 41 formed n one piece, or several sub-brush units. A water baffle 42 is hinged, together with the brush unit 41, to the supporting frame 3, with its center of gravity set in a lower position than that of the brush unit 41. In doing so, the water baffle 42 may always be located at the position right behind the brush unit 41 without turning together with the supporting frame 3, thereby preventing the used water from spraying at the apparatus. In addition, a guide plate 421 is formed at the lower edge of the water baffle 42 so that used water may be gathered with a hose to directly drain away into a nearby sewage system. A row of nozzles 43 for supplying detergent by spraying is provided on the water baffle 42 at a position below the brush unit 41. The nozzles 43 are connected to a detergent container 432 (refer to FIG. 4) mounted on the work platform 1 with a hose 431. A row of nozzles 44 for supplying clean water is provided on the water baffle 42 at a position above the brush unit 41. The nozzles 44 are connected to a water supply source (not shown) with a hose 441. With this structure, the work of cleansing a building wall can be performed orderly and effectively, mixing clean water with detergent first, and then rubbing the wall surface with the brush unit 41. Meanwhile, the brush unit 41 is driven by a motor 45 mounted on the supporting frame 3. In addition, in order to produce a relevant pressure against the wall surface, the tilted angle of the supporting frame 3 with respect to the wall surface can be adjusted when cleansing the wall with the brush unit 41.

A blower unit 5 including a blower body 51 is mounted on the working platform 1, the blower body 51 has an air output exit 52 connected to the blower body 51 with a hose 53. The air output exit 52 is disposed above the brush assembly 4 when cleaning the wall, and the air exit 52 is stretchable and retractable for conveniently performing the work. With this construction, the wall surface 8 can be quickly dried after cleansing. Also, a heater may be installed in the blower body 51 or at the air output exit 52 to supply hot air for performing instant drying of the wall surface.

A control unit 6 is mounted on the working platform 1 for control of the lift unit 2, the supporting frame 3, the brush assembly 4, and the blower unit 5 to work respectively. A control board 61 is extended out of the control unit 6 therefrom both for automatic and manual operation.

Several detector units 7 are scatteringly equipped on the blower unit 5, on the air output exit 52, or on the brush assembly 4 for detecting the distance between the cleansing apparatus and the wall surface 8 to thereby automatically adjust the brush assembly 4 to maintain the most suitable inclined angle with the wall surface 8.

Figure 3:
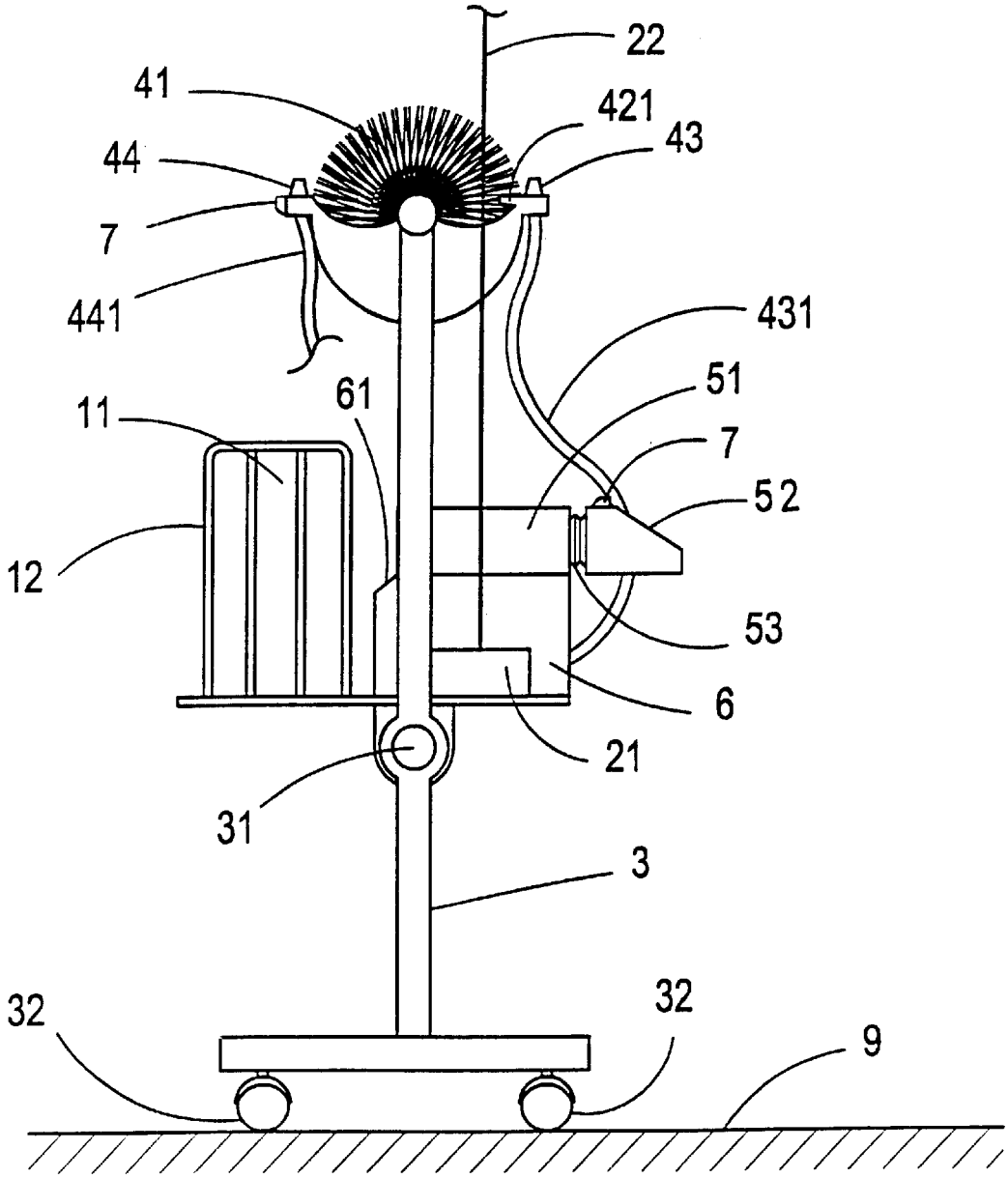
FIG. 3 is a drawing showing the state wherein the apparatus of the present invention is rested on the ground.

As shown in FIG. 3, the cleansing apparatus of the present invention can be mounted on the ground 9, resting on the castors 32 of the supporting frame 3, and rolled along the ground 9 together with the working platform 1 thereon.

Figure 4:
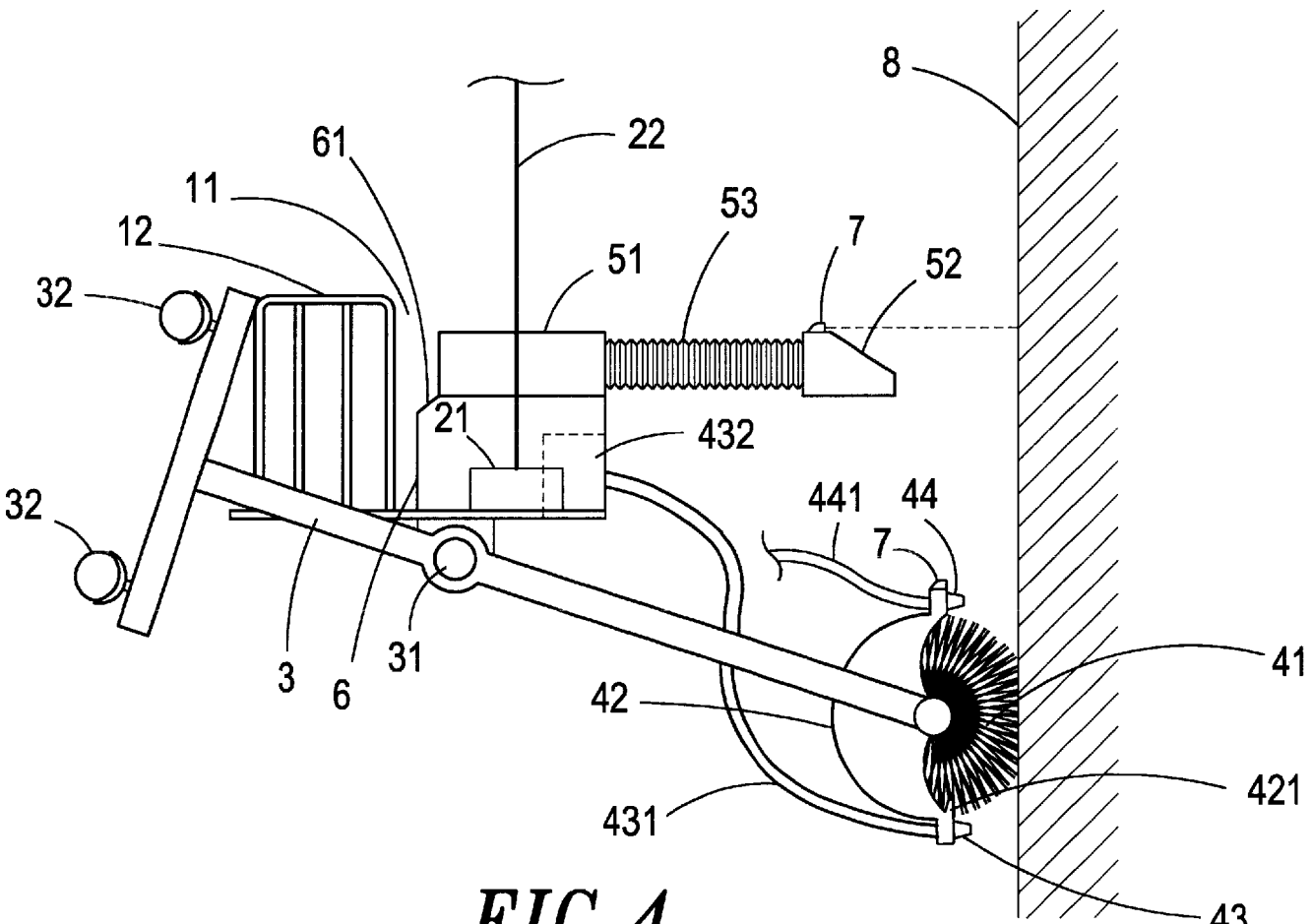
FIG. 4 is a drawing showing the operation state of the present invention.

As shown in FIG. 4, the steps of operating the cleansing apparatus of the present invention are as follows. First, lift the working platform 1 slightly off the ground 9, and turn the brush assembly 4 to a relevant working angle by adjusting the supporting frame 3. Next, the control board 61 is operated to preset operation procedures of each component described above. Then, the working platform 1 is lifted to a topmost position of the building with lifts 21, and the detectors 7 are aimed at the wall surface 8. The work platform 1 is brought down gradually from its highest point and at this moment the control unit 6 will automatically assign the brush assembly 4 to start working by driving the brush unit 41 to rotate with the motor 45, and rub the wall surface 8 with water mixed with detergent supplied by the nozzles 43. Finally, the wall surface 8 is sprayed with clean water supplied by the nozzles 44, and hot air is blown on the wall surface 8 by the blower unit 5, if quick drying is required. After the work is completed, the working platform 1 is brought down to the ground 9 and the supporting frame 3 is restored to its normal upright state with the control unit 6, assuring all components restore the stand by state.

As mentioned above, the distance information between the cleansing apparatus and the wall surface 8 is transmitted to the control unit 6 with a signal output form the sensor 7 equipped at the air output exit 52 or at other places, to adjust the tilted angle of the brush assembly 4 to a relevant value, thereby upgrading the cleansing quality. A portion of the used water mixed with detergent and dust on the wall surface 8 flows down along the wall surface 8, however, most of it would have been scattered here and there by rotating of the brush assembly 4 if it had not been for installation of the water baffle 42. The water baffle 42 gathers most of the used water and conducts it into the sewage system with the hose by the guide plate 421 so as to avoid environmental contamination. Other than automatic control, the cleansing work can be carried out manually by a work crew standing on the platform 1 and operating the control board 61 step by step.

Figure 5:
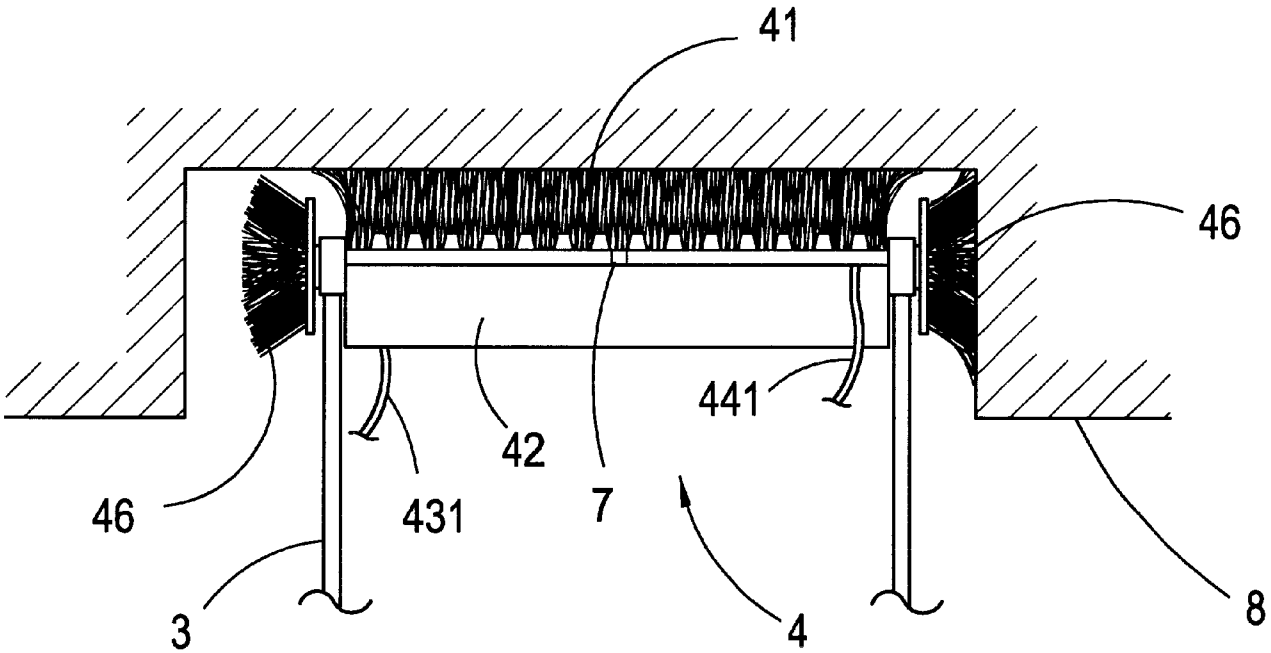
FIG. 5 is a drawing showing the brush assembly in another embodiment of the present invention.

FIG. 5 shows the brush assembly 4 in another embodiment. In this embodiment, an auxiliary rotatable brush 46 is attached to each side of the brush unit 41. The auxiliary brush 46 is used to clean corners, recessed portions and other similar locations where the brush unit 41 cannot reach to clean. In the event the auxiliary brush 46 is not required, it can be detached while the coupling therefore can be lugged with a soft protective filler (not shown).

Figure 6:
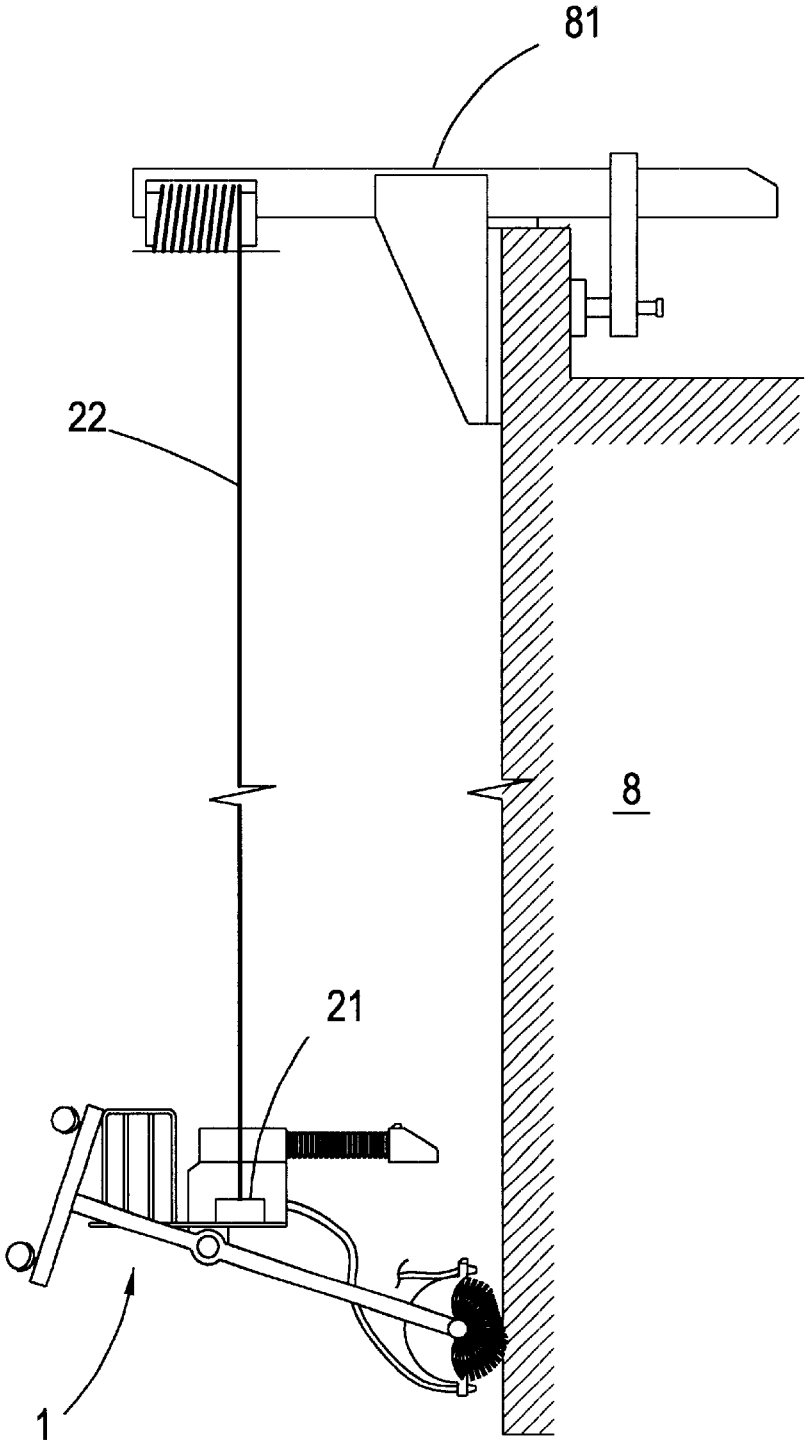
FIG. 6 is a drawing illustrating how the apparatus of the present invention is anchored on the building before operation; and FIG. 7

As shown in FIG. 6, the steel cable 22 of the lift 21 is drawn up and fixed at an anchor base 81 fixed on the topmost portion of the wall surface 8. When both lifts 21 are started, the working platform 1 is moved up and down along the wall surface 8 by pulling force of the steel cable 22.

Figure 7:
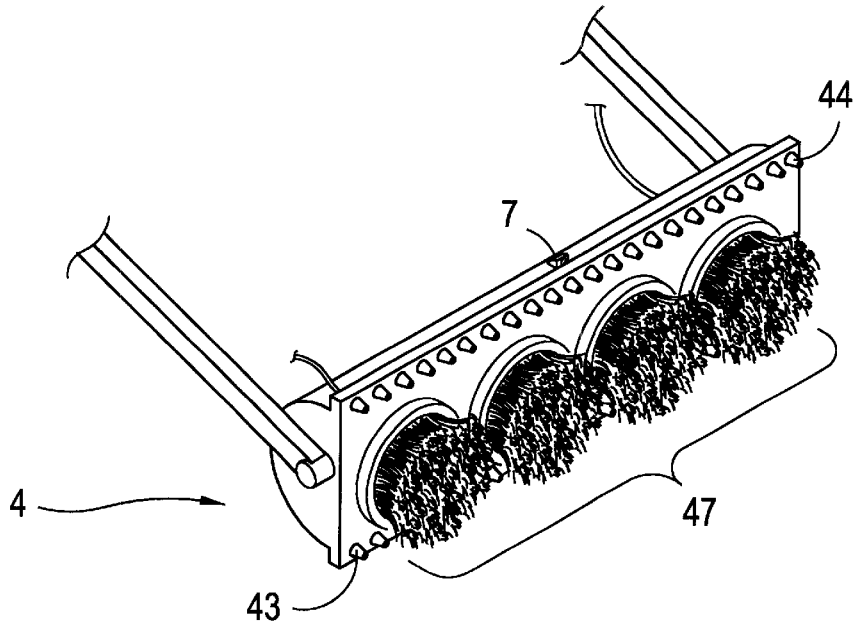
Figure 8:
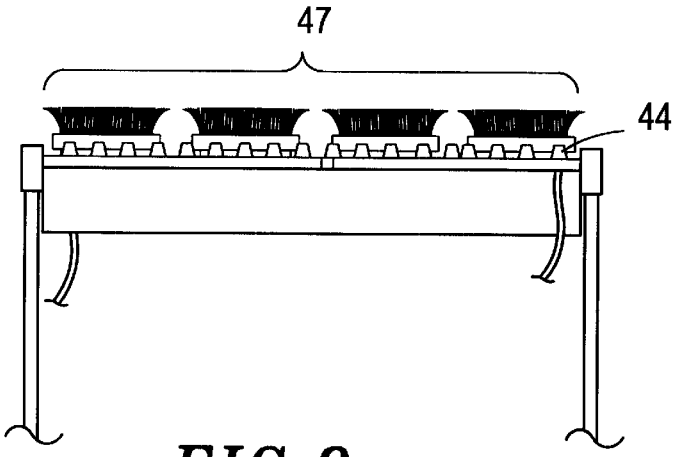
FIG. 8 is a drawing illustrating another brush assembly of the present invention that is anchored on the building before operation.

As shown in FIGS. 7 and 8, the cleansing apparatus of the present invention is carried out in another form, wherein the brush assembly 4 is formed by a plurality of circular disc brush units 47 where adjacent units rotate in opposite directions one with respect to the other, the units 47 being driven by an internal driving mechanism and a gear unit (not shown). Similar to the previous embodiment, after the wall surface 8 has been cleaned by spraying the detergent with the nozzles 43 thereon, it is rubbed and cleaned by the plurality of circular disc brush units 47 rotating in opposite direction one with respect to another. Afterward the clean water 4 is sprayed at the wall surface 8 to finish the cleaning work. Then, the wall surface 8 is dried with air supplied from the blower unit 5. The detector 7 is equipped at a proper position on said brush assembly 4 to detect the distance between the cleansing apparatus and the wall surface 8, to thereby automatically adjust the tilt angle of the brush assembly to the most preferable direction for work.

After having finished reading over the above detailed description of the present invention, one may clearly understand that the automatic wall cleansing apparatus of the present invention is definitely more economical in the interest of labor, time, water and electricity, and much safer compared to apparatuses made according to conventional techniques.

A variety of modifications and variations of the present invention are possible in light of the above teachings. It is therefore to be understood that within the scope of the appended claims, the present invention may be practiced otherwise than as specially described hereinabove.

What is claimed is:

1. An automatic wall cleansing apparatus comprising:

a work platform for transporting a work crew and equipment;

a lift assembly mounted on said work platform for moving said work platform up and down;

a supporting frame pivotally coupled to said work platform;

a brush assembly attached to an end portion of said supporting frame for cleansing a wall surface;

a blower assembly mounted on said work platform, said blower assembly being located above said brush assembly for supplying air to the wall surface after the wall surface is cleansed; and a control assembly mounted on said work platform for controlling operation of said lift unit, said supporting frame, said brush assembly, and said blower assembly.

2. The apparatus of claim 1, wherein said work platform includes a railing to at least partially enclose a space for the work crew to stand thereon.

3. The apparatus of claim 1, wherein said lift assembly includes two lifts respectively coupled to opposing sides of said work platform, each of said lifts being hung by a steel cable which is anchored at a topmost position of a building wall thereby driving said work platform to ascend or descend along the wall surface.

4. The apparatus of claim 1, wherein said supporting frame is pivotally coupled to said work platform with a pivot axle such that said supporting frame is turnable with respect to said pivot axle, said supporting frame having a plurality of castors mounted to a bottom portion thereof for supporting said supporting frame when turned to a position perpendicular to the ground, said castors being used to transport said work platform on the ground.

5. The apparatus of claim 1, wherein said brush assembly has a rotatable brush unit, a water baffle provided behind said brush unit is hinged to said supporting frame together with said brush unit, a row of nozzles for spraying detergent is provided on said water baffle at a position below said brush unit, said nozzles being connected with a hose to a detergent container mounted on said work platform, a row of water nozzles for supplying clean water is provided on said water baffle at a position above said brush unit, said water nozzles being connected to a water supply source with a hose, the work of cleansing the wall surface being performed orderly and effectively by mixing clean water with detergent, and then cleansing the wall surface with said brush unit.

6. The apparatus of claim 5, wherein said rotatable brush unit is formed in one whole piece or divided in several pieces.

7. The apparatus of claim 5, wherein said brush unit is formed of at least one circular disc brush.

8. The apparatus of claim 5, wherein said brush unit is driven by a motor mounted on said supporting frame.

9. The apparatus of claim 5, wherein an auxiliary rotatable brush is selectively attached to each side of said brush unit for cleansing uneasily reachable corners of the wall surface.

10. The apparatus of claim 5, wherein a protective filler is plugged into each side of said brush unit to protect said brush unit.

11. The apparatus of claim 5, wherein a guide plate is formed at a lower edge of said water baffle so that used water is gathered thereat and directly discharged into a nearby sewage system.

12. The apparatus of claim 5, wherein a center of gravity of said water baffle is set in a position so that said water baffle is always located directly behind said brush unit.

13. The apparatus of claim 1, wherein said blower assembly includes a blower body mounted on said work platform, said blower body having an air output exit connected to said blower body with a hose, said hose being stretchable and retractable for convenience of performing work.

14. The apparatus of claim 1, wherein a control board is extended out of said control unit.

15. The apparatus of claim 1, wherein a detector unit is equipped on said blower unit for detecting a distance between said brush assembly and the wall surface.

16. The apparatus of claim 1, wherein, a detector unit is equipped on said brush assembly for detecting the distance between said brush assembly and said wall surface.

* * * * *